US010226781B2

(12) United States Patent
Franks

(10) Patent No.: US 10,226,781 B2
(45) Date of Patent: Mar. 12, 2019

(54) ON-DEMAND, INLINE, ADJUSTABLE PSI COMMERCIAL GRADE BATTERY POWERED FLUID PUMP APPARATUS WITH MANUAL PUMP OPTION

(71) Applicant: BMF TECHNOLOGIES, LLC, Derry, NH (US)

(72) Inventor: Barry Franks, Londonderry, NH (US)

(73) Assignee: BMF TECHNOLOGIES, LLC, Derry, NH (US)

( * ) Notice: Subject to any disclaimer, the term of this patent is extended or adjusted under 35 U.S.C. 154(b) by 0 days.

(21) Appl. No.: 15/591,981

(22) Filed: May 10, 2017

(65) Prior Publication Data

US 2018/0326437 A1 Nov. 15, 2018

(51) Int. Cl.
*B05B 9/08* (2006.01)

(52) U.S. Cl.
CPC ..... *B05B 9/0816* (2013.01); *B05B 9/0861* (2013.01)

(58) Field of Classification Search
CPC ... B05B 9/0816; B05B 9/0861; B05B 9/0877; B05B 9/0883; B05B 9/085; B05B 9/0426; B05B 9/0406; B05B 9/0811
See application file for complete search history.

(56) References Cited

U.S. PATENT DOCUMENTS 4,154,401 A * 5/1979 Thompson ..... B05B 9/0833 222/402
4,768,714 A 9/1988 Luchsinger ..... 239/142
4,798,333 A 1/1989 Luchsinger ..... 239/142
4,801,088 A * 1/1989 Baker ..... B05B 9/0861 222/175
4,881,687 A * 11/1989 Ballu ..... B05B 9/0816 239/332
D336,127 S 6/1993 Slaybaugh ..... D23/225
5,335,853 A 8/1994 Wirz ..... 239/142
D394,067 S 5/1998 Kon ..... D15/7
6,109,548 A * 8/2000 George ..... B05B 9/0805 222/333
D570,447 S 6/2008 Hillhouse ..... D23/225
D578,182 S 10/2008 Moran et al. ..... D23/225
7,731,105 B2 6/2010 Lishanski et al. ..... 239/332
(Continued)

OTHER PUBLICATIONS

Office Action issued in U.S. Appl. No. 29/630,336, dated Jun. 25, 2018 (18 pgs).

*Primary Examiner* — Nicholas J. Weiss
(74) *Attorney, Agent, or Firm* — Hayes Soloway P.C.

(57) ABSTRACT

An automated chemical fluid applicator apparatus includes a container of fluid chemical having an integrated pressurization device and an outlet for releasing the fluid chemical. A portable, battery-powered fluid pumping apparatus is retrofitable to the container and has housing having at least one fluid inlet port and at least one fluid outlet port, wherein the at least one fluid inlet port is connectable to the outlet of the container. A liquid diaphragm pump is positioned within the housing. A battery is removably connectable to a battery terminal connector formed on the housing, wherein the battery powers the liquid diaphragm pump. A control switch is positioned on the housing and controls activation of the liquid diaphragm pump to expel the quantity of fluid chemical from the at least one fluid outlet port.

20 Claims, 9 Drawing Sheets

(56) References Cited

U.S. PATENT DOCUMENTS

| | | | | |
|---|---|---|---|---|
| 7,753,290 | B2 * | 7/2010 | Jacques | A01M 7/0046 239/146 |
| D672,847 | S | 12/2012 | Woodling | D23/202 |
| 8,616,466 | B2 | 12/2013 | Strauss et al. | 239/154 |
| 8,672,364 | B2 | 3/2014 | Schrum et al. | 285/33 |
| D712,933 | S * | 9/2014 | DeOreo | D15/7 |
| D713,502 | S | 9/2014 | Nicolia et al. | D23/225 |
| 8,864,476 | B2 * | 10/2014 | Moormann | F04B 17/06 417/411 |
| 8,985,482 | B1 | 3/2015 | Schrum et al. | 239/333 |
| D741,372 | S | 10/2015 | Smith, Sr. | D15/7 |
| D766,988 | S | 9/2016 | Crowsley et al. | D15/7 |
| D771,718 | S | 11/2016 | Liao et al. | D15/7 |
| D780,291 | S | 2/2017 | Schrum et al. | D23/225 |
| D784,414 | S | 4/2017 | Schrum et al. | D15/7 |
| D787,325 | S | 5/2017 | Young | D9/448 |
| D809,625 | S | 2/2018 | Bonaventura | D23/225 |
| 9,889,464 | B1 * | 2/2018 | Winne | B05C 17/00 |
| 2006/0076435 | A1 * | 4/2006 | Hudson | B05B 9/0861 239/332 |
| 2011/0057436 | A1 | 3/2011 | Schrum et al. | 285/33 |
| 2015/0258558 | A1 | 9/2015 | Schrum et al. | B05B 7/2491 |
| 2017/0106385 | A1 | 4/2017 | Schrum et al. | B05B 9/043 |

* cited by examiner

ON-DEMAND, INLINE, ADJUSTABLE PSI COMMERCIAL GRADE BATTERY POWERED FLUID PUMP APPARATUS WITH MANUAL PUMP OPTION

FIELD OF THE DISCLOSURE

The present disclosure is generally related to pumping devices and more particularly is related to an on-demand, inline, adjustable PSI commercial grade battery-powered fluid pump apparatus with manual pump option.

BACKGROUND OF THE DISCLOSURE

Fluid chemicals are used as pesticides, fungicides, insecticides, and related items to exterminate and prevent the presence of pests in various environments. Frequently, fluid chemicals are contained in tanks or containers having integrated pumping devices, such as manually-operated pumping devices like plunger handles, or automated pumping devices such as motorized pumping devices. For example, a pump tank holding chemical pesticides is commonly used for the industrial or commercial pest control industry, as well as larger termite rigs or grander landscaping tanks. These integrated pumping devices operate by pressurizing the air contained within the tank which creates a pressurized force on the fluid chemical within the tank. When an outlet of the tank is opened, the pressurized air forces the fluid chemical out of the outlet.

This type of system, however, has numerous shortcomings. For one, pressurizing the air within a tank requires a great deal of energy due to the large volume of space within the tank, which only increase as fluid chemical is expelled from the tank. Thus, the integrated pumping device must often operate on a continual basis as the fluid is expelled, which is inefficient from a power consumption standpoint, and can require significant physical effort for users to continually pump the manually-operated pressurization devices. Additionally, as soon as the fluid chemical is expelled from the tank, the air pressure within the tank decreases due to the relationship between the quantity of fluid expelled and the resulting increase in volume within the tank. As a result, the pressure level at which the fluid is expelled is difficult to regulate and maintain. This difficulty is not trivial, as the Environmental Protection Agency (EPA) has guidelines which dictate the pressure level (PSI) at which certain chemical fluid pesticides should be sprayed in various settings. For example, when spraying indoors, many chemical pesticides must be sprayed at 20 PSI which is difficult to achieve and maintain with air-pressurization pumping systems.

Thus, a heretofore unaddressed need exists in the industry to address the aforementioned deficiencies and inadequacies.

SUMMARY OF THE DISCLOSURE

Embodiments of the present disclosure provide an automated chemical fluid applicator apparatus and related systems and methods. Briefly described, in architecture, one embodiment of the apparatus, among others, can be implemented as follows. A container holds a quantity of fluid chemical. The container has an integrated pressurization device for pressurizing the quantity of fluid chemical at a first pressure level, and an outlet for releasing at least a portion of the quantity of fluid chemical. A portable, battery-powered fluid pumping apparatus is retrofitable to the container. The portable, battery-powered fluid pumping apparatus has a housing having at least one fluid inlet port and at least one fluid outlet port, wherein the at least one fluid inlet port is connectable to the outlet of the container. A liquid diaphragm pump is positioned within the housing. A battery is removably connectable to a battery terminal connector formed on the housing, wherein the battery powers the liquid diaphragm pump. A control switch is positioned on the housing, wherein activation of the control switch engages the liquid diaphragm pump to expel the quantity of fluid chemical in the first pressure level received from the at least one fluid inlet port through the at least one fluid outlet port at a second pressure level, wherein the second pressure level is greater than the first pressure level.

The present disclosure can also be viewed as providing a portable, battery-powered fluid pumping apparatus. Briefly described, in architecture, one embodiment of the apparatus, among others, can be implemented as follows. A housing has at least one fluid inlet port and at least one fluid outlet port. A liquid diaphragm pump is positioned within the housing. A battery is removably connectable to a battery terminal connector formed on the housing, wherein the battery powers the liquid diaphragm pump. A control switch is positioned on the housing, wherein activation of the control switch engages the liquid diaphragm pump to expel a quantity of fluid received from the at least one fluid inlet port through the at least one fluid outlet port in a pressurized state.

The present disclosure can also be viewed as providing a method of applying fluid chemical in a pressurized state to a surrounding environment. In this regard, one embodiment of such a method, among others, can be broadly summarized by the following steps: providing a container holding a quantity of fluid chemical, the container having an integrated pressurization device for pressurizing the quantity of fluid chemical, and an outlet for releasing at least a portion of the quantity of fluid chemical; and retrofitting a portable, battery-powered fluid pumping apparatus to the container, the portable, battery-powered fluid pumping apparatus having: a housing having at least one fluid inlet port and at least one fluid outlet port, wherein the at least one fluid inlet port is connectable to the outlet of the container; a liquid diaphragm pump positioned within the housing; a battery removably connectable to a battery terminal connector formed on the housing, wherein the battery powers the liquid diaphragm pump; and a control switch positioned on the housing; and expelling the quantity of fluid chemical within the container from at least one outlet port of the portable, battery-powered fluid pumping apparatus in a pressurized state, wherein the pressurized state is created by any of: the integrated pressurization device alone; the liquid diaphragm pump alone; and a combination of the integrated pressurization device and the liquid diaphragm pump.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
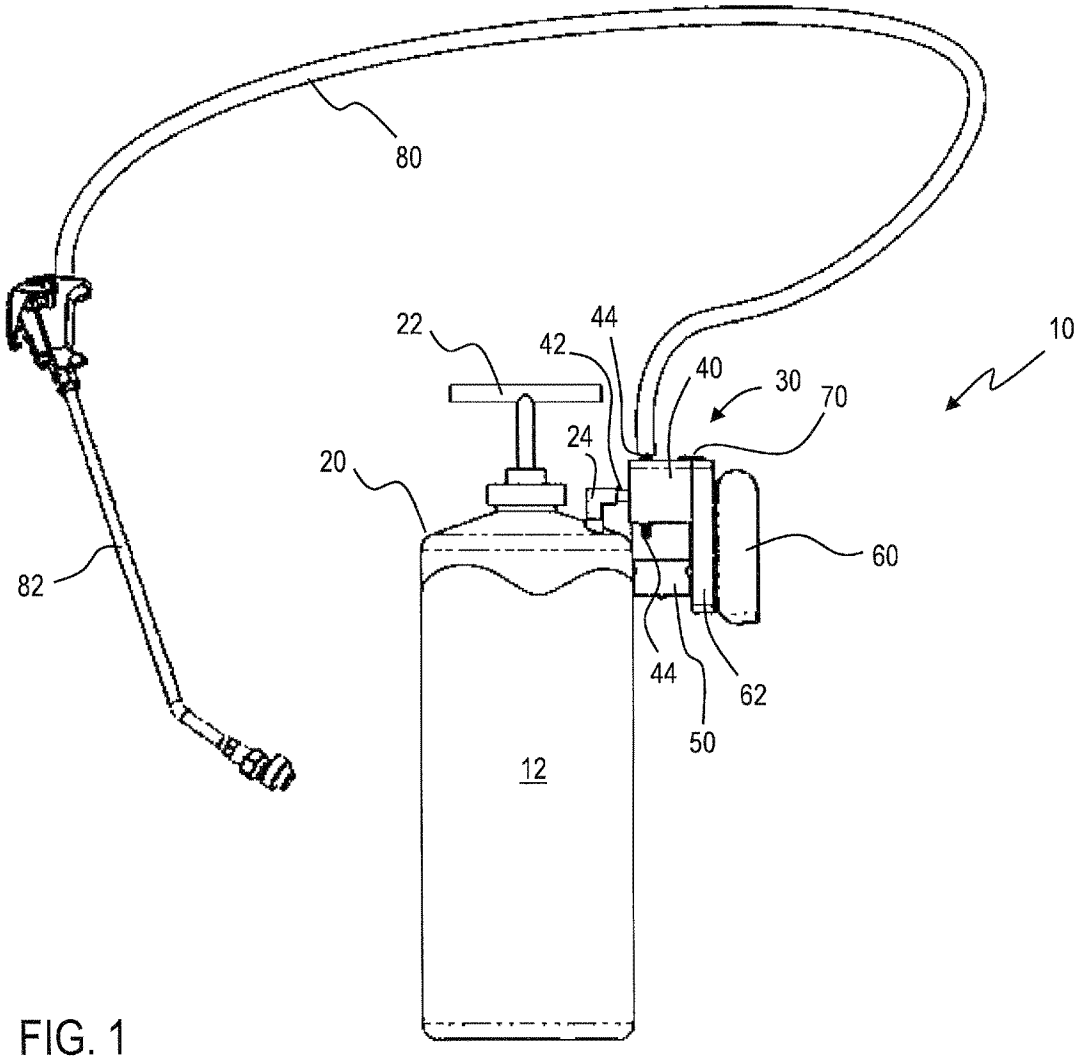
FIG. 1 is a side view illustration of an automated chemical fluid applicator apparatus, in accordance with a first exemplary embodiment of the present disclosure.

FIG. 1 is a side view illustration of an automated chemical fluid applicator apparatus 10, in accordance with a first exemplary embodiment of the present disclosure. The automated chemical fluid applicator apparatus 10, which may be referred to simply as 'apparatus 10' has a container 20 holding a quantity of fluid chemical 12. The container 20 has an integrated pressurization device 22 for pressurizing the quantity of fluid chemical 12 at a first pressure level, and an outlet 24 for releasing at least a portion of the quantity of fluid chemical 12. A portable, battery-powered fluid pumping apparatus 30 is retrofitable to the container 20. The portable, battery-powered fluid pumping apparatus 30 has a housing 40 having at least one fluid inlet port 42 and at least one fluid outlet port 44, wherein the at least one fluid inlet port 42 is connectable to the outlet of the container 20. A liquid diaphragm pump 50 is positioned within the housing 40. A battery 60 is removably connectable to a battery terminal connector 62 formed on the housing 40, wherein the battery 60 powers the liquid diaphragm pump 50. A control switch 70 is positioned on the housing 40. Activation of the control switch 70 engages the liquid diaphragm pump 50 to expel the quantity of fluid chemical 12 in the first pressure level received from the at least one fluid inlet port 42 through the at least one fluid outlet port 44 at a second pressure level. The second pressure level is greater than the first pressure level, such that the quantity of fluid chemical 12 is expelled from a hose 80 and nozzle 82 at a greater pressure than that of the fluid chemical 12 in the container 20.

The apparatus 10 overcomes the shortcomings of the conventional devices described in the Background by allowing the fluid chemical 12 to be expelled at an accurate and consistent pressure level, which meets the regulations put forth by the Environmental Protection Agency (EPA) and other oversight organizations pertaining to the application of fluid chemicals in pesticide operations. Furthermore, the use of a battery-powered device over that of a hardwired, plugged-in, or manually operated device allows the apparatus 10 to be transported to virtually any location without limitation, and allows for proper application of the fluid chemical 12 without significant manual effort, such as that required by manually-operated devices. Additionally, the apparatus 10 can function to pressurize the chemical fluid 12 under various constraints, such as loss of battery power. For example, the chemical fluid 12 can be pressurized with just the integrated pressurization device 22, or with just the liquid diaphragm pump 50, or with a combination of the integrated pressurization device 22 and the liquid diaphragm pump 50. Thus, a user can rely on the integrated pressurization device 22 when the battery 60 experiences a power depletion or the user can rely on the liquid diaphragm pump 50 operated by the battery 60 to sidestep the use of a manually-pumped integrated pressurization device 22, as shown in FIG. 1, where a user is required to pump the handle of the integrated pressurization device 22 to pressurize the air within the container 20.

As shown in FIG. 1, the portable, battery-powered fluid pumping apparatus 30 may be retrofit or attached to the container 20 or a component of the container 20. For example, in FIG. 1, the portable, battery-powered fluid pumping apparatus 30 is attached to the container through the outlet 24 connection extending from the container 20 to the inlet port 42 of the housing 40. Other positions and locations of the portable, battery-powered fluid pumping apparatus 30 relative to the container 20 may also be used, including the use of additional mechanical attachments between the housing 40 and the container 20 to secure the portable, battery-powered fluid pumping apparatus 30 to the container 20.

The portable, battery-powered fluid pumping apparatus 30 may include a housing 40 that is manufactured from durable materials such as plastics and metals, such that the housing 40 provides protection to the internal components of the portable, battery-powered fluid pumping apparatus 30. The liquid diaphragm pump 50 may be positioned fully or partially within the housing 40, and in most cases will have at least a portion thereof positioned external of the housing 40 to allow for proper ventilation and cooling of the liquid diaphragm pump 50. Any number of outlet ports 44 may be located on the housing 40, including an upper outlet port 44 located on a top side of the housing 40 and a lower outlet port 44 located on a bottom side of the housing 40. The inlet and outlet ports 42, 44 may include any type of fluid tubing or piping connection, such as threaded connections, press-on or snap-fit connections, or other mechanical connections to allow for various tubing, pipes, and hoses to be secured thereto.

The housing 40 of the portable, battery-powered fluid pumping apparatus 30 may further include an integrated battery terminal connector 62 which may be molded into the body of the housing 40 or otherwise attached to the housing 40. The battery terminal connector 62, as further discussed relative to FIGS. 4-6, may include a specific design to allow for a battery 60 to be removable therefrom, such that the battery 60 can be easily switched out when it is depleted of power. The battery 60 may include different types of batteries 60, for example commercial grade, lithium tool DC batteries 60 that are larger 24 v, which may be similar to the batteries used to operate portable drilling tools. The battery terminal connector 62 may include electrical contact areas which physically connect to contacts of the battery 60 to allow for the transfer of electrical power from the battery 60 and to the liquid diaphragm pump 50 of the portable, battery-powered fluid pumping apparatus 30. The electrical connection therebetween incorporates at least one control switch 70 which the user can actuate the liquid diaphragm pump 50 and control the flow of the fluid chemical 12 from the apparatus 10. The control switch 70 may include any number or types of control devices and may include not only the ability for the user to engage or disengage operation of the liquid diaphragm pump 50 but also select a pressurization level at which to dispel the chemical fluid 12. For example, the control switch 70 may include a selector knob or button which allows the user to selectively control the specific PSI of the fluid being expelled.

Once the chemical fluid 12 has achieved the desired pressure level within the portable, battery-powered fluid pumping apparatus 30, whether from the integrated pressurization device 22, the liquid diaphragm pump 50, or a combination thereof, the chemical fluid 12 may be expelled through a hose 80 attached to the outlet port 44 of the portable, battery-powered fluid pumping apparatus 30. The hose 80 may be connected to a spraying handle 82 which the user can hold to direct the location of spraying the chemical fluid 12. The spraying handle 82 may include various controls and switches, such as a handle with integrated trigger for releasing the chemical fluid 12 from the end nozzle of the spraying handle 82. Other types of spraying devices may also be used, all of which are included within the scope of the subject disclosure.

Figure 2:
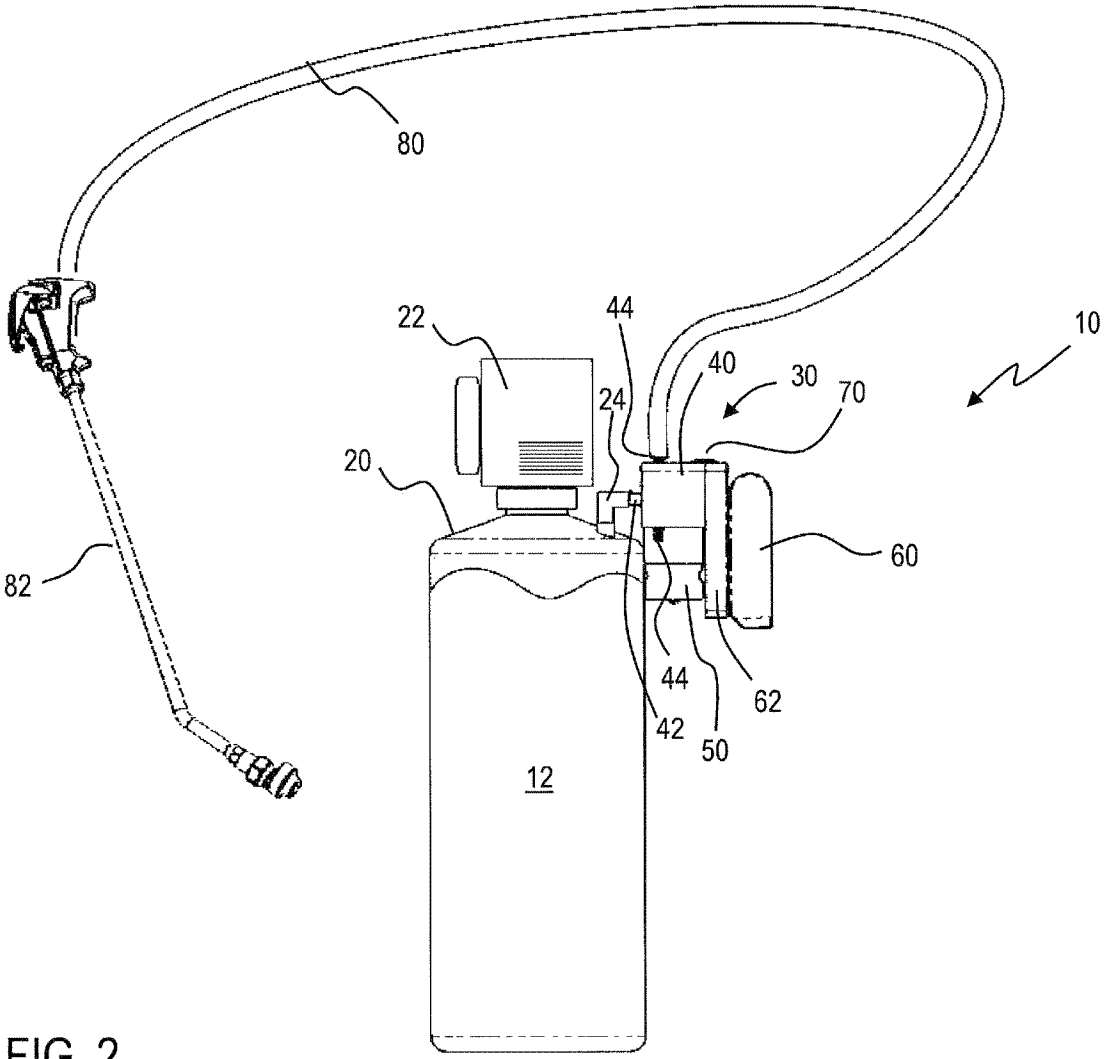
FIG. 2 is a side view illustration of an automated chemical fluid applicator apparatus, in accordance with the first exemplary embodiment of the present disclosure.

FIG. 2 is a side view illustration of an automated chemical fluid applicator apparatus 10, in accordance with the first exemplary embodiment of the present disclosure. In contrast to the apparatus 10 of FIG. 1, FIG. 2 illustrates the container 20 having a mechanically-activated integrated pressurization device 22, which may be a motor or similar pumping device connected to the container 20. It has been found within the industry that mechanically-activated integrated pressurization devices of containers can frequently experience failures in operation which renders the entire unit unusable. The owners of these devices do not desire to replace the motors because of the high costs associated with it. The use of the components of the portable, battery-powered fluid pumping apparatus 30 of apparatus 10 can allow a user to retrofit the portable, battery-powered fluid pumping apparatus 30 to the existing containers to allow them to be used without the existing motor.

Figure 3:
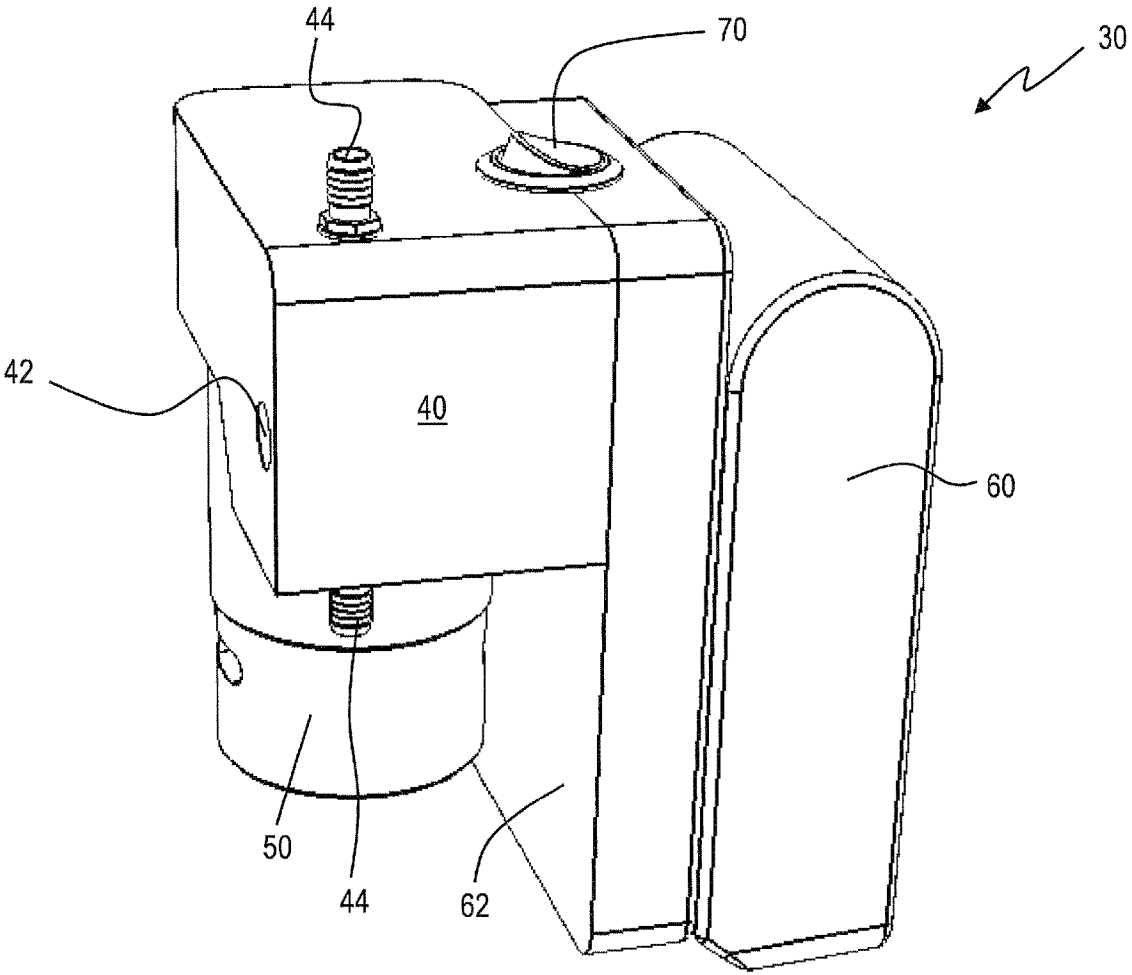
FIG. 3 is an elevated, angled side view illustration of the portable, battery-powered fluid pumping apparatus of the automated chemical fluid applicator apparatus of FIGS. 1-2, in accordance with the first exemplary embodiment of the present disclosure.
Figure 4:
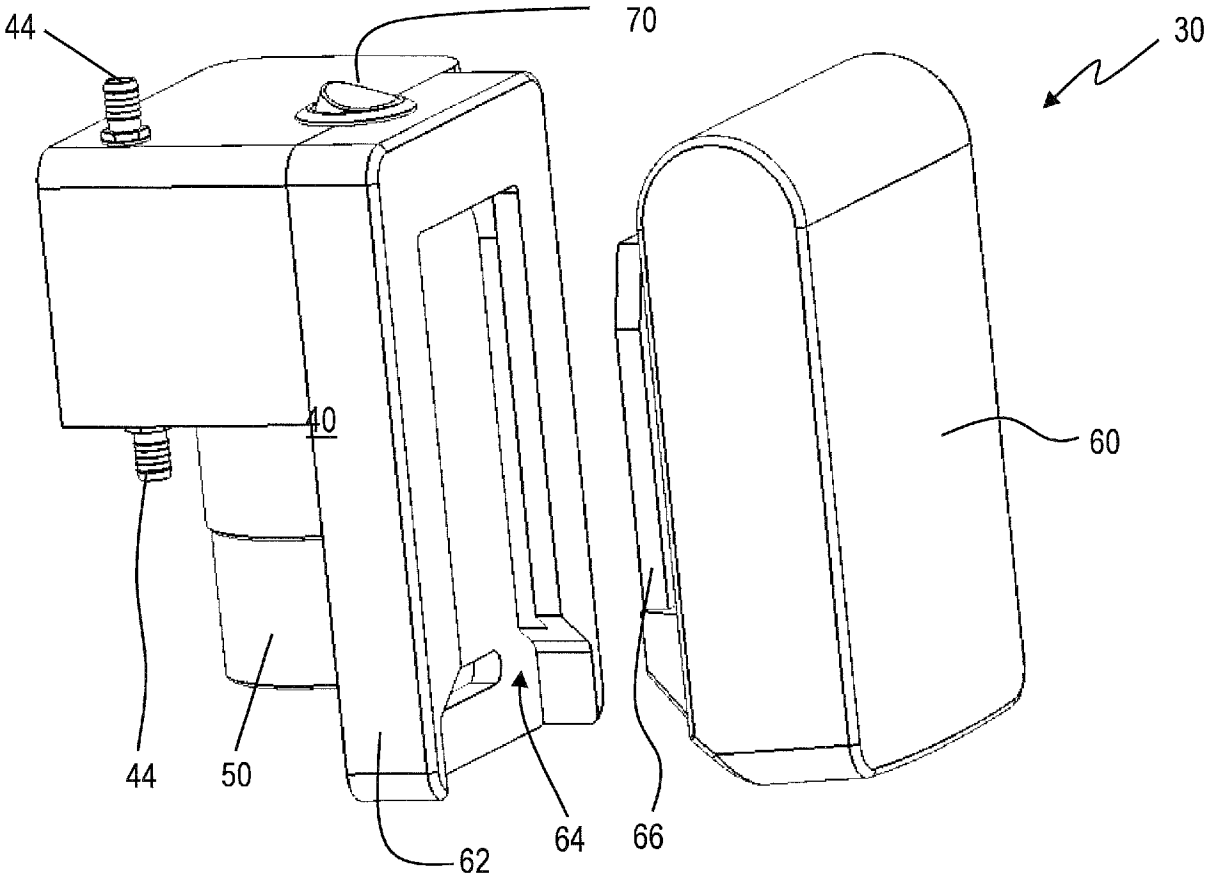
FIG. 4 is an exploded, elevated, angled side view illustration of the portable, battery-powered fluid pumping apparatus of the automated chemical fluid applicator apparatus of FIGS. 1-2, in accordance with the first exemplary embodiment of the present disclosure.
Figure 5:
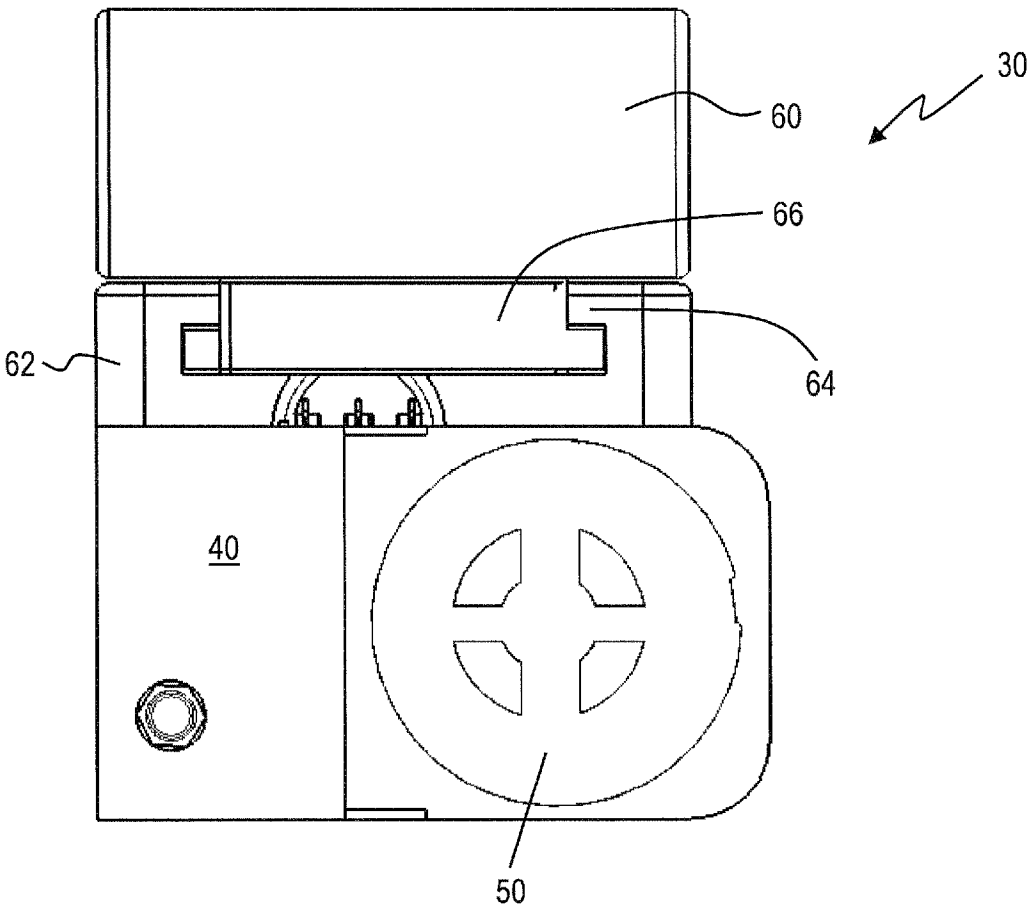
FIG. 5 is a bottom view cross-sectional illustration of the portable, battery-powered fluid pumping apparatus of the automated chemical fluid applicator apparatus of FIGS. 1-2, in accordance with the first exemplary embodiment of the present disclosure.
Figure 6:
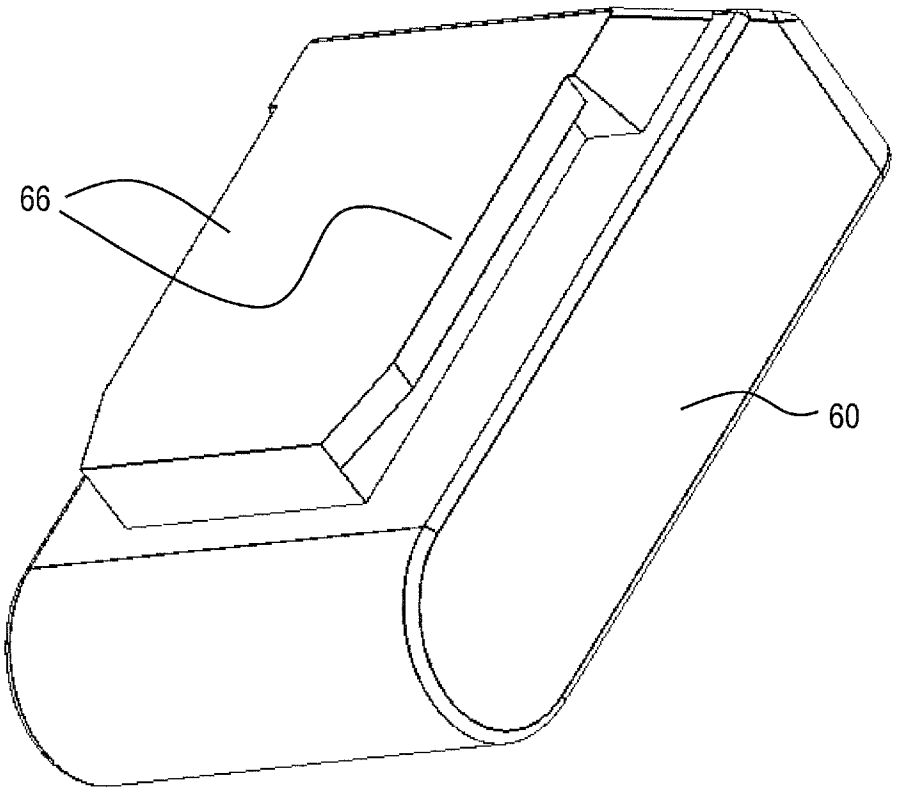
FIG. 6 is an angled side view illustration of the battery of the automated chemical fluid applicator apparatus of FIGS. 1-2, in accordance with the first exemplary embodiment of the present disclosure.

FIG. 3 is an elevated, angled side view illustration of the portable, battery-powered fluid pumping apparatus 30 of the automated chemical fluid applicator apparatus 10 of FIGS. 1-2, in accordance with the first exemplary embodiment of the present disclosure. FIG. 4 is an exploded, elevated, angled side view illustration of the portable, battery-powered fluid pumping apparatus 30 of the automated chemical fluid applicator apparatus 10 of FIGS. 1-2, in accordance with the first exemplary embodiment of the present disclosure. FIG. 5 is a bottom view cross-sectional illustration of the portable, battery-powered fluid pumping apparatus 30 of the automated chemical fluid applicator apparatus 10 of FIGS. 1-2, in accordance with the first exemplary embodiment of the present disclosure. FIG. 6 is an angled side view illustration of the battery 60 of the automated chemical fluid applicator apparatus 10 of FIGS. 1-2, in accordance with the first exemplary embodiment of the present disclosure.

With reference to FIGS. 3-6, the components of the portable, battery-powered fluid pumping apparatus 30 are shown in detail, where it can be seen how the battery 60 is removably connectable to the battery terminal connector 62 which is interfaced with the housing 40. As can also be seen, the control switch 70 may be positioned at a readily accessible location on the housing 40, such as at the top, such that a user can quickly and easily use the control switch 70. While a toggle-type control switch 70 is depicted in FIGS. 3-4, it is noted that various different types of switches may be used, including those which offer more than a binary (on/off) control of the liquid diaphragm pump 50, e.g., such that a user can select a variety of different pressures at which to expel the chemical fluid from the apparatus 10.

As shown in FIGS. 4 and 6, the battery 60 may have a nesting system which allows the battery 60 to fit in a predetermined location within the battery terminal connector 62. In particular, the battery 60 may have protruding rails 66 which includes flared edges which can be received within slot or guide system 64 of the battery terminal connector 62, such that the battery 60 can be positioned below the battery terminal connector 62 and slid upwards until the protruding rails 66 engage with the guide system 64. The battery 60 may be held in this position in the battery terminal connector 62 by means of friction or with a mechanical lock which prevents the battery 60 from inadvertent removal from the battery terminal connector 62. Further, the battery 60 and the battery terminal connector 62 may include various features and designs which aid in the convenient insertion and removal of the battery 60. For example, angled or chamfered edges may be incorporated into the protruding rails 66 and the overall shape of the protruding rails 66 may include a tapered design which allows the protruding rails to nest within the guide system 64. The cross-sectional view of FIG. 5 illustrates the protruding rails 66 being positioned within the guide system 64 of the battery terminal connector 62.

Figure 7:
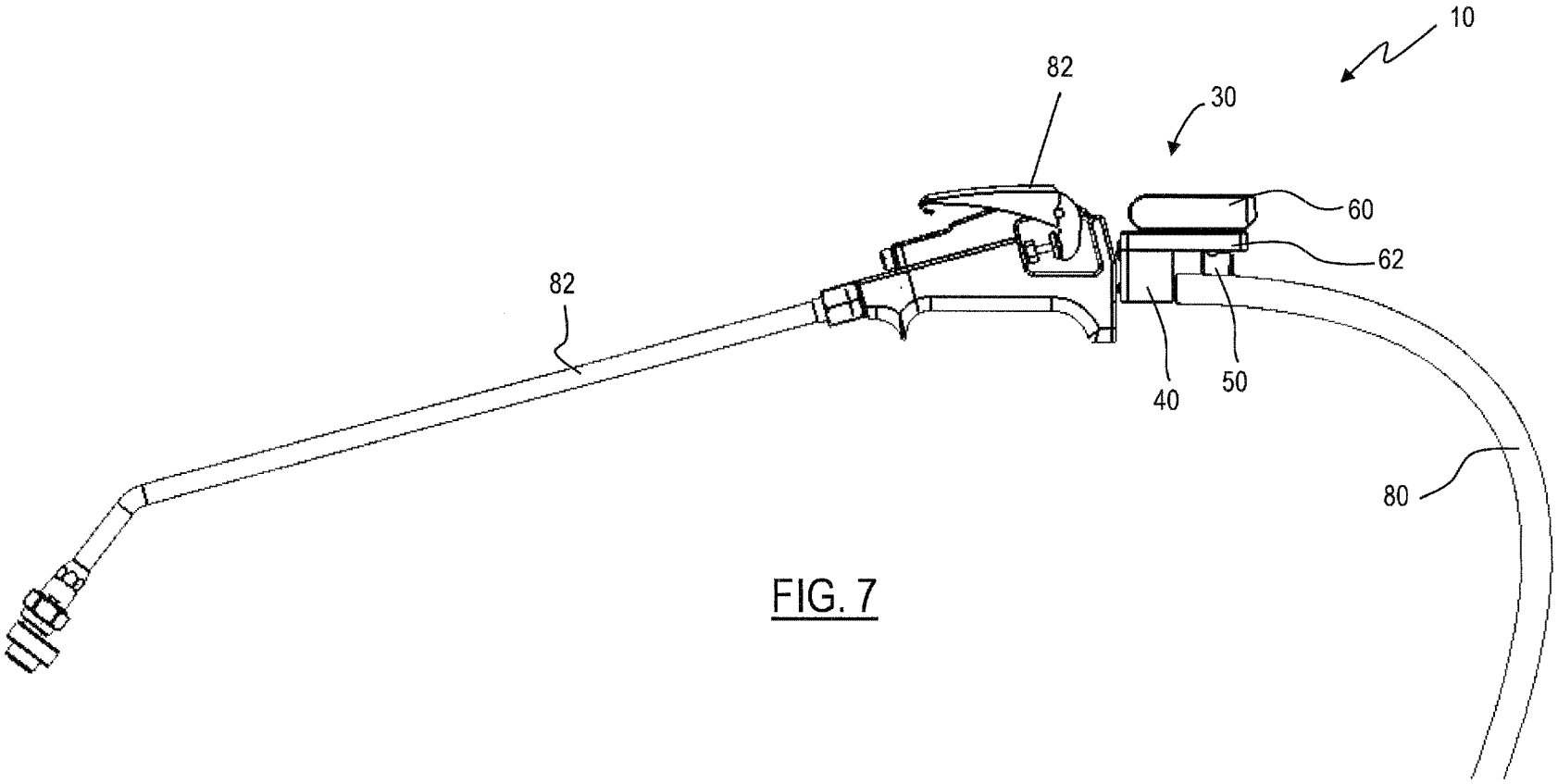
FIG. 7 is a side view illustration of the automated chemical fluid applicator apparatus, in accordance with the first exemplary embodiment of the present disclosure.
Figure 8:
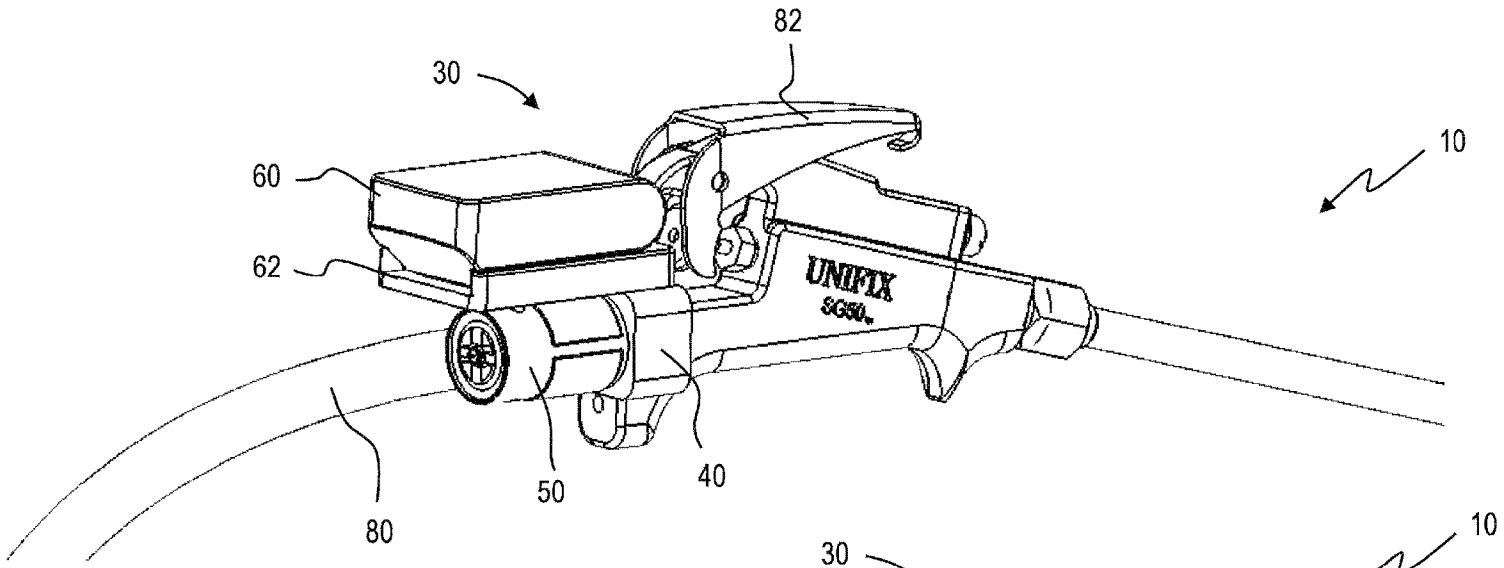
FIG. 8 is an opposing side view illustration from FIG. 7 of the automated chemical fluid applicator apparatus, in accordance with the first exemplary embodiment of the present disclosure.
Figure 9:
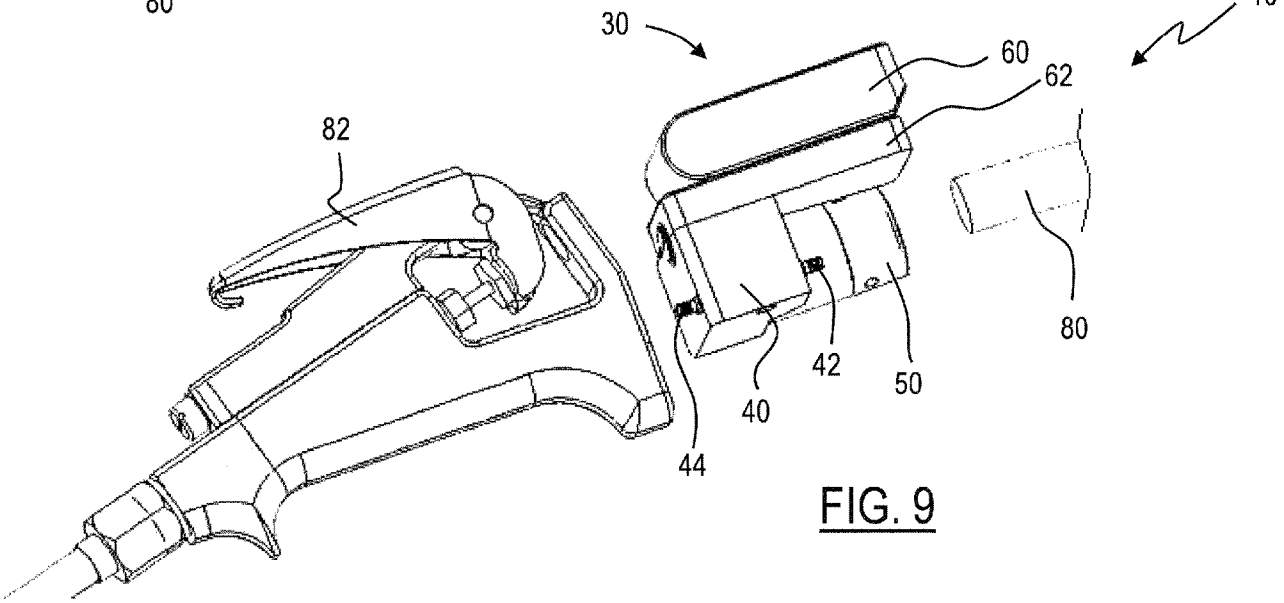
FIG. 9 is an exploded side view illustration of the automated chemical fluid applicator apparatus, in accordance with the first exemplary embodiment of the present disclosure.

FIG. 7 is a side view illustration of the automated chemical fluid applicator apparatus 10, in accordance with the first exemplary embodiment of the present disclosure. FIG. 8 is an opposing side view illustration from FIG. 7 of the automated chemical fluid applicator apparatus 10, in accordance with the first exemplary embodiment of the present disclosure. FIG. 9 is an exploded side view illustration of the automated chemical fluid applicator apparatus 10, in accordance with the first exemplary embodiment of the present disclosure. With reference to FIGS. 7-9, the automated chemical fluid applicator apparatus 10 shown has a design modification from that depicted in FIGS. 1-6, where, in FIGS. 7-9, the portable, battery-powered fluid pumping apparatus 30 is mounted to the spraying handle 82 and connected to the container (not shown) with the hose 80.

In this design, the apparatus 10 may function the same way as described relative to FIGS. 1-6, where the portable, battery-powered fluid pumping apparatus 30 can pressurize the chemical fluid stored within a container, which is drawn through the hose 80 from the container and expelled into the spray handle 82. The portable, battery-powered fluid pumping apparatus 30 may have the same components as described relative to FIGS. 1-6, including the housing 40 with fluid inlet port 42 and fluid outlet ports 44, a liquid diaphragm pump 50, a battery terminal connector 62 which can receive a battery 60, and a control switch 70 which controls activation of the liquid diaphragm pump 60. As can be seen in FIG. 9, the fluid inlet port 42 may be positioned on the bottom of the portable, battery-powered fluid pumping apparatus 30, whereby fluid is drawn through the fluid path within the housing 40 and expelled from the outlet port 44 which is connected directly to the spray handle 82. Thus, the fluid inlet ports 42 and fluid outlet ports 44 may be interchangeable based on the configuration of use of the apparatus 10 to allow the apparatus 10 to be positioned in line with the container in any configuration, e.g., where FIGS. 1-6 used a side-mounted fluid inlet port to receive the chemical fluid and the apparatus 10 in the design of FIGS. 7-9 uses a bottom mounted fluid inlet port 42.

Based on the disclosure of the apparatus 10 of FIGS. 1-9, it is evident that the subject invention can greatly improve upon the conventional state of devices which require manual (physical human-powered) pressurization of the tanks, or have mechanical motors which have fails. To this end, the apparatus 10 provides adjusted to perfection pressurized liquid to the technician squeezing the trigger of the spray handle without any manual pumping. The inventions benefits are substantial, and as an inline battery operated commercial grade unit, the apparatus 10 can be mounted on the technicians pump spray tank or on the end of the spray gun or another location therebetween. One familiar with the pest control industry would recognize that use of battery power to pressurize only the liquid at the immediate demanded PSI, and not pressurize the air within a tank, can provide substantial benefits in allowing the technician to move around an application setting unrestricted by power cords while maintaining proper application pressure. As previously noted, pressurizing the air in the tank is a slow process which consumes a great deal of energy to pressurize the large volume of space. Pressurizing the liquid of fluid chemical itself, however, requires substantially less energy, thus making the battery-powered apparatus 10 feasible whereas using a battery-powered pressurization device for air pressurization is not. Further, it should be recognized that the apparatus 10 may allow for convenient application of pest control chemicals in less than satisfactory conditions, such as, for example, when a technician needs to stand on a tall ladder or in a similarly dangerous place, where manual pumping or pressurization of a tank increases the likelihood for injury to the technician.

Moreover, the use of the apparatus 10 offers the technician the ability to meet an exact or near exact pressure level. The EPA has guidelines per state for what PSI to spray chemicals indoors and this PSI requirement, which is normally 20 PSI is written on chemical labels. These chemicals may include a variety of different types, including insecticides, herbicides, pesticides, fungicides, germicides, or others. The apparatus 10 can be equipped with a multi speed selector allowing for legal indoor spraying per EPA and Government standards but also allowing technicians to reach difficult settings, such as bee nest(s) located high above the ground, such as in trees, rooflines, or in large warehouses without having to pump the manual pump tank, since the technician can simply increase the PSI level with the control switch/selector.

Another benefit of the apparatus 10 is that the technician does not have to wait for tank air to pressurize in order to pressurize the liquid. Rather, the on demand PSI pump pumps immediately at the designated pressure setting. However, if while the technician is using the apparatus 10, the battery were to be depleted of power, the technician still has the ability to use the apparatus 10 under the power of the integrated pressurization device, e.g., by manually pressurizing the tank air. Thus, if the technician has almost completed a job and the battery dies, he or she can still finish the job without interruption. To this end, it is noted that the technician could also replace the battery with a spare, fully charged battery and continue the job.

As previously described, the apparatus 10 may be equipped with at least one liquid entry point and at least one liquid exit point. The liquid entering can be non-pressurized, allowing the technician to pump the pressure as normal with a manual pump. Or, if the apparatus 10 is activated, the technician can enjoy use of the apparatus 10 without pumping the liquid. In this case, the liquid would be non-pressurized on entry and then correctly pressurized upon exit by the selected PSI regulator. The apparatus 10 can be mounted on any existing pump tank or non-pump tank, and it can be mounted anywhere in line between the tank and the liquid nozzle. The apparatus may further include two outlets in the pump. One outlet will be normally open and one outlet will be normally closed. The one outlet which is open stays open allowing liquid to enter. The second, normally closed outlet will open under pressure either by the battery pump creating the pressure or pressure being created by the manual pump.

It is further noted that the tank or container used in the apparatus 10 does not have to be pressurized, and does not even need a cap to work, e.g., the container does not need to be capable of being pressurized. An advancement of the apparatus 10 within the industry is that it allows for the ability to be mounted onto professional industry pump tanks and also as part of it design allows for the pump tank to work as a normal pump tank with the unit attached inline when the unit fails to perform due to a dead battery or no battery present. The function of the pump tank will operate as usual without disconnecting the invention from the pump tank. This feature is a designed feature which incorporates a check valve into the front port of the liquid pump allowing the liquid to pass through the liquid pump when the pump is not operating if and when the liquid is pressurized from the source of the professional pump tank.

Figure 10:
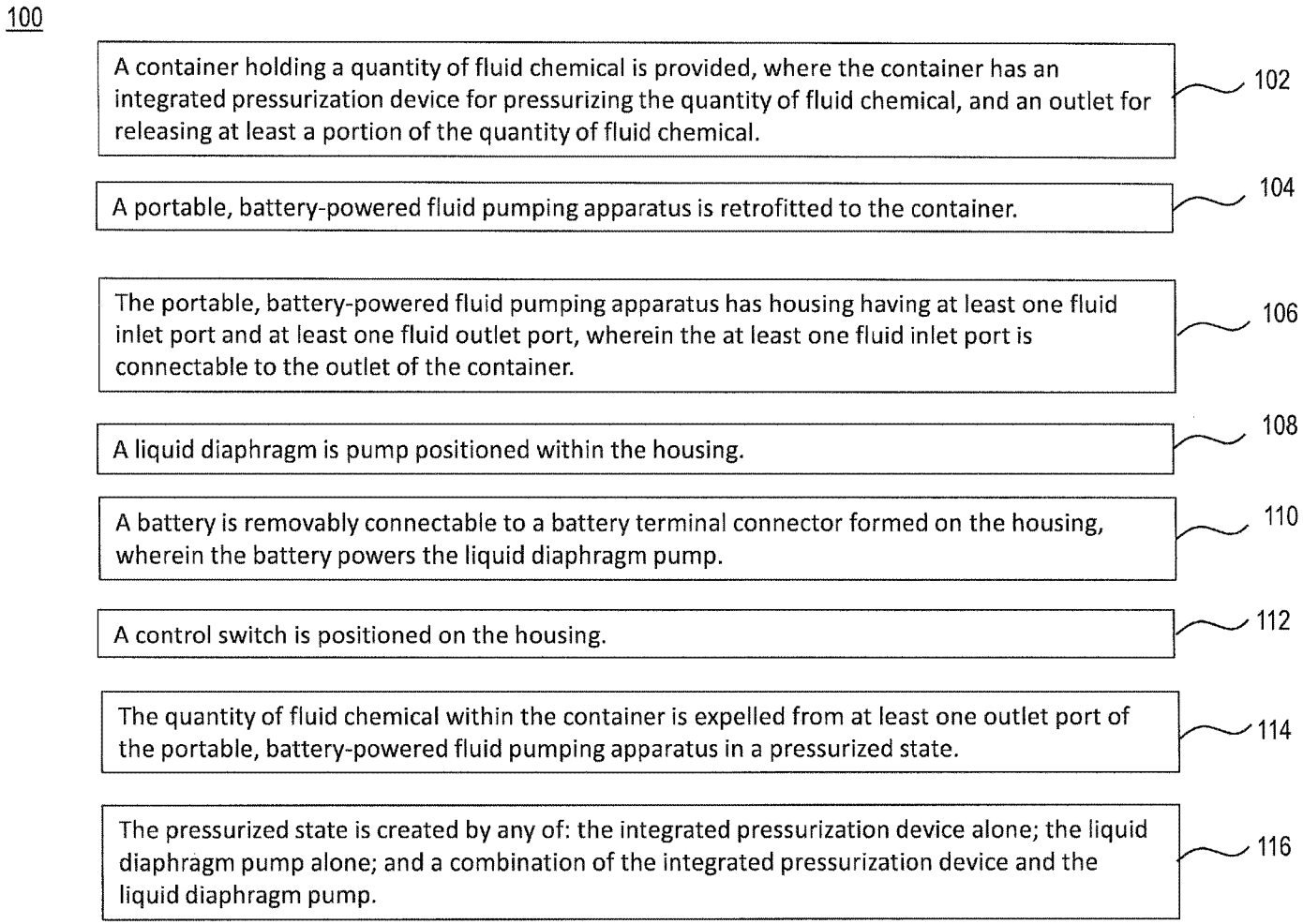
FIG. 10 is a flowchart illustrating a method of applying fluid chemical in a pressurized state to a surrounding environment, in accordance with the first exemplary embodiment of the disclosure.

FIG. 10 is a flowchart 100 illustrating a method of applying fluid chemical in a pressurized state to a surrounding environment, in accordance with the first exemplary embodiment of the disclosure. It should be noted that any process descriptions or blocks in the flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a container holding a quantity of fluid chemical is provided, where the container has an integrated pressurization device for pressurizing the quantity of fluid chemical, and an outlet for releasing at least a portion of the quantity of fluid chemical. A portable, battery-powered fluid pumping apparatus is retrofitted to the container (block 104). The portable, battery-powered fluid pumping apparatus has housing having at least one fluid inlet port and at least one fluid outlet port, wherein the at least one fluid inlet port is connectable to the outlet of the container (block 106). A liquid diaphragm is pump positioned within the housing (block 108). A battery is removably connectable to a battery terminal connector formed on the housing, wherein the battery powers the liquid diaphragm pump (block 110). A control switch is positioned on the housing (block 112). The quantity of fluid chemical within the container is expelled from at least one outlet port of the portable, battery-powered fluid pumping apparatus in a pressurized state (block 114). The pressurized state is created by any of: the integrated pressurization device alone; the liquid diaphragm pump alone; and a combination of the integrated pressurization device and the liquid diaphragm pump (block 116).

The method may further include any of the steps, features, or functions disclosed or described relative to FIGS. 1-9. For example, expelling the quantity of fluid chemical within the container from at least one outlet port of the portable, battery-powered fluid pumping apparatus in the pressurized state may occur while the integrated pressurization device is in a non-operational state. Expelling the quantity of fluid chemical within the container from at least one outlet port of the portable, battery-powered fluid pumping apparatus in the pressurized state may occur while the liquid diaphragm pump is in a non-operational state due to depletion of a power level of the battery. A level of the pressurized state of the quantity of fluid chemical may be controlled with a pressure selection switch positioned on the housing.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An automated chemical fluid applicator apparatus comprising:

a container holding a quantity of fluid chemical, the container having an integrated pressurization device for pressurizing the quantity of fluid chemical at a first pressure level, and an outlet for releasing at least a portion of the quantity of fluid chemical; and a portable, battery-powered fluid pumping apparatus connectable to the container, the portable, battery-powered fluid pumping apparatus having:

a housing having at least one fluid inlet port and at least one fluid outlet port, wherein the at least one fluid inlet port is connectable to the outlet of the container, wherein the outlet of the container is positioned between the housing and the container and supports the housing in a position fully exterior of the container;

a liquid diaphragm pump positioned within the housing;

a battery removably connectable to a battery terminal connector formed on the housing, wherein the battery powers the liquid diaphragm pump; and a control switch positioned on the housing, wherein activation of the control switch engages the liquid diaphragm pump to expel the quantity of fluid chemical in the first pressure level received from the at least one fluid inlet port through the at least one fluid outlet port at a second pressure level, wherein the second pressure level is greater than the first pressure level.

2. The apparatus of claim 1, wherein the integrated pressurization device of the container further comprises a non-operational integrated pressurization device.

3. The apparatus of claim 1, wherein the fluid chemical further comprises at least one of: an insecticide, a herbicide, a pesticide, a fungicide, and a germicide.

4. The apparatus of claim 1, wherein a pressurization level of the second pressure level is adjustable.

5. The apparatus of claim 1, wherein the first pressure level is 0 PSI and the second pressure level is 20 PSI.

6. The apparatus of claim 1, wherein the battery further comprises a removable, rechargeable, DC lithium tool battery.

7. The apparatus of claim 1, wherein the integrated pressurization device of the container further comprises at least one of: a plunger pump; and a pump motor.

8. An automated chemical fluid applicator apparatus comprising:

a container holding a quantity of fluid chemical, the container having an integrated pressurization device for pressurizing the quantity of fluid chemical at a first pressure level, and an outlet for releasing at least a portion of the quantity of fluid chemical; and a portable, battery-powered fluid pumping apparatus connectable to the container, the portable, battery-powered fluid pumping apparatus having:

a housing having at least one fluid inlet port and at least one fluid outlet port, wherein the at least one fluid inlet port is connectable to the outlet of the container, wherein the housing is retrofitable to the container using a connection within a fluid hose extending from the container, wherein the portable, battery-powered fluid pumping apparatus is positioned in line with the fluid hose;

a liquid diaphragm pump positioned within the housing;

a battery removably connectable to a battery terminal connector formed on the housing, wherein the battery powers the liquid diaphragm pump; and a control switch positioned on the housing, wherein activation of the control switch engages the liquid diaphragm pump to expel the quantity of fluid chemical in the first pressure level received from the at least one fluid inlet port through the at least one fluid outlet port at a second pressure level, wherein the second pressure level is greater than the first pressure level.

9. The apparatus of claim 8, wherein the integrated pressurization device of the container further comprises a non-operational integrated pressurization device.

10. The apparatus of claim 8, wherein the fluid chemical further comprises at least one of: an insecticide, a herbicide, a pesticide, a fungicide, and a germicide.

11. The apparatus of claim 8, wherein a pressurization level of the second pressure level is adjustable.

12. The apparatus of claim 8, wherein the first pressure level is 0 PSI and the second pressure level is 20 PSI.

13. The apparatus of claim 8, wherein the battery further comprises a removable, rechargeable, DC lithium tool battery.

14. The apparatus of claim 8, wherein the integrated pressurization device of the container further comprises at least one of: a plunger pump; and a pump motor.

15. An automated chemical fluid applicator apparatus comprising:

a container holding a quantity of fluid chemical, the container having an integrated pressurization device for pressurizing the quantity of fluid chemical at a first pressure level, and an outlet for releasing at least a portion of the quantity of fluid chemical; and a portable, battery-powered fluid pumping apparatus connectable to the container, the portable, battery-powered fluid pumping apparatus having:

a housing having at least one fluid inlet port and at least one fluid outlet port, wherein the at least one fluid inlet port is connectable to the outlet of the container, wherein the housing of the portable, battery-powered fluid pumping apparatus is positioned directly adjacent to a spray handle connected to the container with a fluid hose;

a liquid diaphragm pump positioned within the housing;

a battery removably connectable to a battery terminal connector formed on the housing, wherein the battery powers the liquid diaphragm pump; and a control switch positioned on the housing, wherein activation of the control switch engages the liquid diaphragm pump to expel the quantity of fluid chemical in the first pressure level received from the at least one fluid inlet port through the at least one fluid outlet port at a second pressure level, wherein the second pressure level is greater than the first pressure level.

16. The apparatus of claim 15, wherein the fluid chemical further comprises at least one of: an insecticide, a herbicide, a pesticide, a fungicide, and a germicide.

17. The apparatus of claim 15, wherein a pressurization level of the second pressure level is adjustable.

18. The apparatus of claim 15, wherein the first pressure level is 0 PSI and the second pressure level is 20 PSI.

19. The apparatus of claim 15, wherein the battery further comprises a removable, rechargeable, DC lithium tool battery.

20. The apparatus of claim 15, wherein the integrated pressurization device of the container further comprises at least one of: a plunger pump; and a pump motor.

* * * * *